United States Patent [19]

Lottick

[11] Patent Number: 4,494,668

[45] Date of Patent: Jan. 22, 1985

[54] STACKABLE NON-SPILLABLE DRINKING CONTAINER

[76] Inventor: Edward A. Lottick, 41 Gershom Pl., Kingston, Pa. 18704

[21] Appl. No.: 575,201

[22] Filed: Feb. 2, 1984

Related U.S. Application Data

[63] Continuation-in-part of Ser. No. 480,565, Mar. 30, 1983, Pat. No. 4,441,640.

[51] Int. Cl.[3] ..... A47G 21/18; A47G 19/22; B65D 47/04

[52] U.S. Cl. ..... 220/90.4; 215/1 A; 220/90.2; 229/7 S

[58] Field of Search ..... 220/90.2, 90.4, 90.6; 229/7 S; 215/1 A

[56] References Cited

U.S. PATENT DOCUMENTS 1,243,033 10/1917 Beatty ..... 215/1 A
2,948,453 8/1960 Drown .
3,106,312 10/1963 Hitchcock .
3,438,257 4/1969 Gamblin ..... 215/1 A
4,448,316 5/1984 Hiroshige ..... 215/1 A

*Primary Examiner*—George E. Lowrance
*Attorney, Agent, or Firm*—Michael F. Petock

[57] ABSTRACT

A non-spillable drinking container is manufactured in assemblable parts which provide stackability and reduced manufacturing costs. The drinking container utilizes a perforated expandable diaphragm mounted or formed over a base plate. The container is preferably frustro-conical in shape to provide stackability. A drinking tube is attachable to the expandable diaphragm and a top is sealably mountable over the tube. Drinking is accomplished by pulling upwardly on the tube to expand the diaphragm opening the perforations therein, allowing fluid flow through the perforations and up the straw to the mouth of the drinker.

10 Claims, 7 Drawing Figures

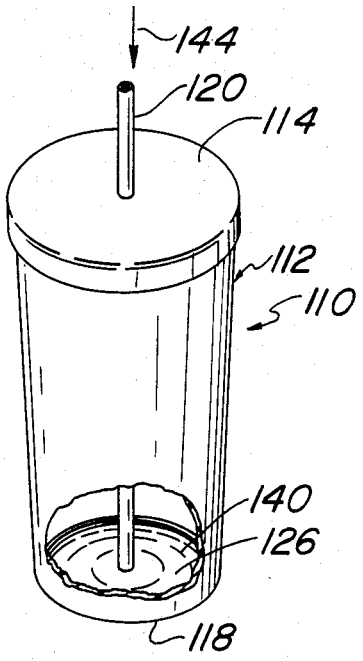
FIG. 1
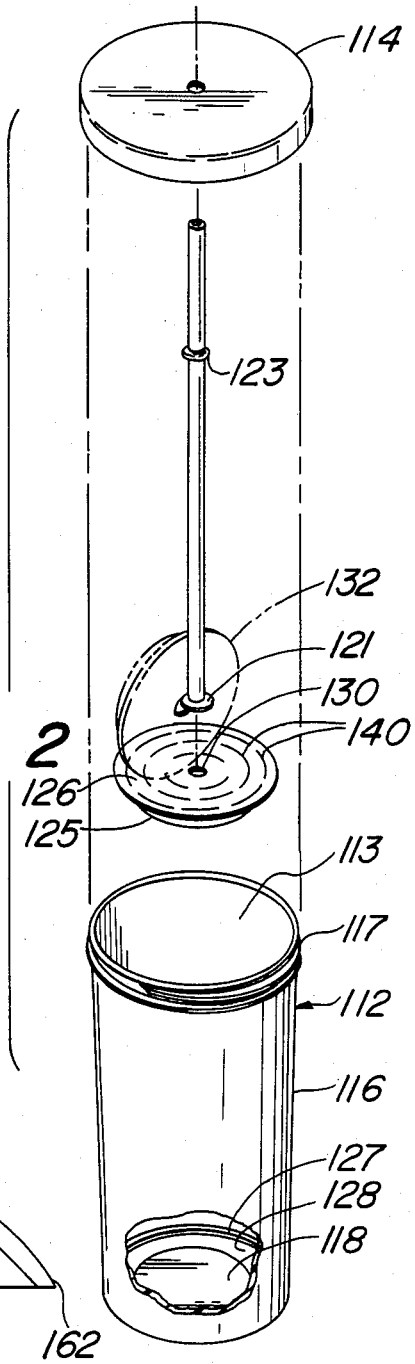
FIG. 2
FIG. 7
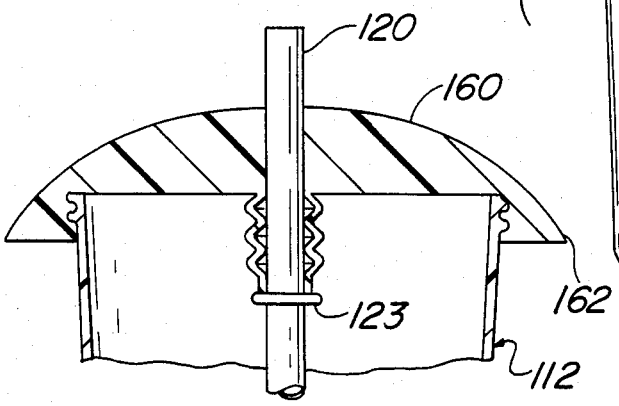

STACKABLE NON-SPILLABLE DRINKING CONTAINER

CROSS-REFERENCE TO RELATED APPLICATION

This application is a Continuation-in-Part application of application Ser. No. 480,565, filed Mar. 30, 1983, now U.S. Pat. No. 4,441,640, patented Apr. 10, 1984, by the inventor herein entitled NON-SPILLABLE DRINKING CONTAINER. The subject in its entirety of this parent application is incorporated herein by reference.

BACKGROUND OF THE INVENTION

The present invention is directed to a stackable non-spillable drinking container which includes the inventive concepts disclosed in the parent application and further provides the important advantages of stackability and reduced manufacturing cost.

In the past there had been a need for an effective non-spillable drinking container. There are many applications where such a drinking container would be extremely desirable. Applications include anywhere where there is a need to prevent spills of fluids being drunk, such as soda pop or juice, and there is some increased reason for the likelihood of spillage. For example, soda pop dispensed in movie theaters in drinking cups often results in the spillage by children of some or all of the soda pop on the floor, carpeted aisles, or even the seats, especially during the drinking process. Even with respect to adults, very often the adults will discard the cup of soda on the floor before the cup is completely empty. Unfortunately, the cup is often kicked or bumped over by a patron or otherwise upset before it is removed by the cleaning personnel at the end of the day. This results in a sticky mess on the floor of the theater which involves additional costs in cleaning, and is further likely to reduce the life of items such as carpeting and seat coverings.

Additionally, such a non-spillable drinking container is highly desirable in other applications where there is an increased probability of spillage during drinking, such as in hospitals and nursing homes with debilitated patients and in moving vehicles such as airplanes, boats, ships, trains and automobiles.

In many applications, it is highly desirable for the non-spillable drinking container to be disposable. In other words, once it is used by a movie theater patron or a hospital patient, it may be discarded, there being no intent to retrieve the containers, clean them and reuse them. However, in order for a drinking container to be disposable, it is desirable to keep the cost of manufacture of the container as low as possible. Furthermore, it is highly desirable that a drinking container be stackable to reduce the cost of shipment and storage of the large number of containers which may be utilized where a container is disposable after use.

A non-spillable liquid drinking container is shown in U.S. Pat. No. 2,948,453-Drown. Drown discloses a capable cup in which a perforated straw is spring mounted within a cylindrical tube within the cup. Downward pressure on the straw forces a portion of the straw out of the cylindrical tube to enable flow of liquid through the straw.

The prior art does not disclose a non-spillable drinking container which does not allow spillage even should it be dropped to the floor in a turned down manner. The non-spillable liquid drinking container disclosed in the Drown patent has a removable top and furthermore, if it hit the floor in an upside down manner, the drinking straw would be forced against the spring allowing flow out through the straw. In accordance with the present invention, there is no need to exercise any manual control and the non-spillable drinking container of the present invention automatically provides a non-spill function.

SUMMARY OF THE INVENTION

In accordance with the present invention, a stackable non-spillable drinking container is provided wherein the cost of manufacture and use is reduced both in the manufacture and assembly of the components and in the shipment and storage of the containers prior to use.

The present invention provides a stackable drinking container wherein the container, once assembled, is always in the condition where spills may be avoided, even where a reasonable amount of pressure is applied to the container, or the container is dropped upside down.

Briefly and basically, in accordance with the present invention, there is provided a stackable non-spillable liquid drinking container. A container of linearly increasing cross-section is provided with an open mouth at its larger end and a closed bottom at or near the smaller end. In a preferred embodiment, this container will be of a frustro-conical shape, although it is understood that various other cross-sectional shapes other than that of a cone may be provided, such as hexagonal, octagonal, square, rectangular, etc. A base plate is provided with an expandable diaphragm mounted over substantially one surface of the base plate. The expandable diaphragm is provided with perforations therethrough which are normally closed in the unexpanded state of the expandable diaphragm and which are open when the expandable diaphragm is stretched by movement of a central portion of said diaphragm away from the surface of the base plate. The expandable diaphragm includes means for attachment to a drinking tube. Once the tube is attached to the expandable diaphragm, the base plate is secured in juxtaposition to the bottom of the container. A top for the container is securably mountable over the open mouth of the container. The top includes means for moveably mounting the tube through the top with means for forming a seal between the moveable tube and the top.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective, partially broken away, of a stackable non-spillable drinking container fully assembled in accordance with the present invention.

FIG. 2 is a view in perspective of the assembly of a stackable non-spillable drinking container in accordance with the present invention.

FIG. 7 is a broken away cross-sectional view illustrating an alternate top for the container.

DETAILED DESCRIPTION OF THE PREFERRED EMBODIMENTS

Figure 3:
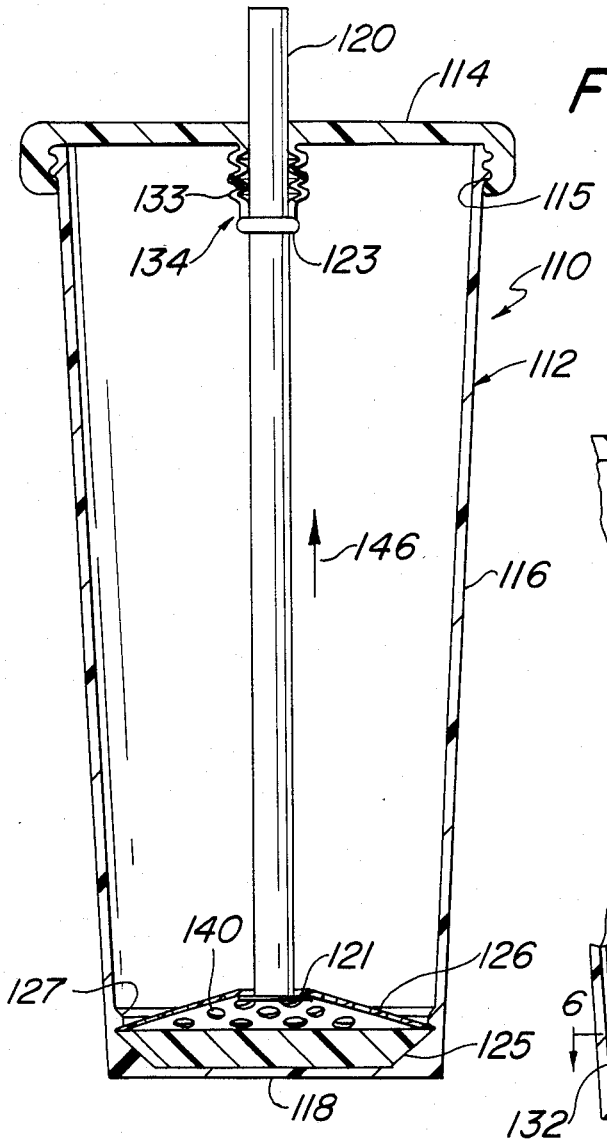
FIG. 3 is a cross-sectional elevation view taken along a center line of a non-spillable drinking container in accordance with the present invention with the expandable diaphragm shown in its expanded state.

Referring now to the drawings, wherein like numerals indicate like elements, there is shown in FIGS. 1, 2 and 3 a stackable non-spillable drinking container 110. The present invention may be understood best by simultaneously referring to FIGS. 1, 2 and 3, FIG. 1 being an assembled container with the expandable diaphragm in the unexpanded condition, FIG. 2 being an assembly view and FIG. 3 being a cross-sectional view of an assembled container with the expandable diaphragm in the expanded condition.

The overall non-spillable stackable drinking container is comprised of a container 112 with a top 114 which is securably mountable to the container. Container 112 is formed of a linearly increasing cross-section. The degree of linear increase of cross-sectional size may be preferably selected to maximize the stackability of container 112. Container 112 may be comprised of a sidewall 116 with an open mouth 113 at its larger cross-sectional area and a closed bottom 118 at or near the smaller end. Although bottom 118 is shown being formed flat with the lower ends of sidewall 116, it is understood that the sidewall 116 may project for a slight distance beyond bottom 118 if so desired. Sidewall 116 preferably may be frustro-conical in shape. However, it is understood that the increasing cross-sectional area of container 112 may be provided with other cross-sectional shapes, including, but not limited to, hexagonal, octagonal, rectangular, square, etc. The primary concern is to provide a container 112 of linearly increasing cross-sectional area proceeding from the closed bottom to the open top to provide stackability. However, as discussed hereinafter, top 114 is preferably threadably securably mounted over open mouth 113 of container 112, and the selection of a shape other than frustro-conical for container 112 would require that top 114 be mounted by means other than screw threads, such as a snap on top or a slideable closure.

Figure 6:
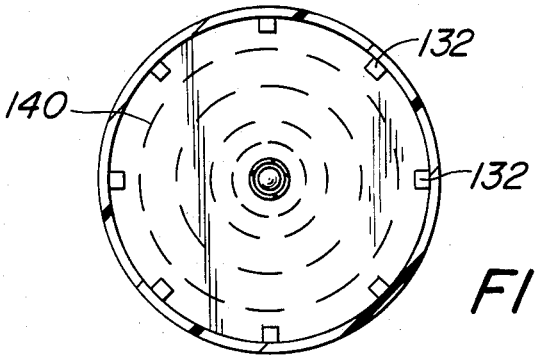
FIG. 6 is a cross-sectional plan view taken along line 6—6 of FIG. 5 of an alternate embodiment of the present invention illustrating another alternative means of securing the base plate in juxtaposition to the bottom of the container.

In accordance with the invention described in the parent application, of which this application is a Continuation-in Part Application, the stackable non-spillable drinking container is provided with an expandable diaphragm 126 having a plurality of perforations 140 which may be slits which may be opened when the drinker pulls upwardly in the direction of arrow 146. Normally slits 140 are closed when expandable diaphragm 126 is not in its expanded condition. The perforations 140 in expandable diaphragm 126 may be in the form of slits 140 as shown in FIGS. 1, 2 and 6. Preferably, these slits, in the unexpanded condition of diaphragm 126 may be formed to have their longitudinal direction perpendicular to the imaginary radial lines of diaphragm 126. Therefore, when there is an upward tension in the direction of arrow 146 on a central portion of diaphragm 126, perforations or slits 140 would be forced open to their maximum condition as diaphragm 126 is expanded. When tube 120 is retracted in the direction of arrow 144 by the release of the upward tension 146 by the lips of the drinker, diaphragm 126 is in its unexpanded condition and perforations or slits 140 are closed. When tube 120 is pulled upwardly in the direction of arrow 146 by the lips or fingers of a drinker, expandable diaphragm 126 is expanded opening perforations 140 which allows fluid flow through the open perforations 140 and up through tube 120 into the mouth of the drinker. When tube 120 is released, it is retracted in the direction of arrow 144 by the elastic forces of contracting diaphragm 126 which may be assisted by sealing means 134 when it is in the form of a bellows 133.

In accordance with the invention described herein, a base plate 125 is provided. An expandable diaphragm 126, as previously described, is mounted to one surface or side of base plate 125. Expandable diaphragm 126 is provided with a means for attaching tube 120 to it. In a preferred embodiment, this attachment means may be the combination of rim 121 formed on the lower end of tube 120 and an opening 130 in a central portion of expandable diaphragm 126. The expandable diaphragm, with its combined base plate 125, may be readily attached to tube 120 by slanting or cocking the expandable diaphragm with respect to rim 121 as shown at 132 in FIG. 2 and forceably inserting rim 121 through opening 130. Once the expandable diaphragm 126 and base plate 125 are attached to the lower end of tube 120, the unit may be inserted into container 112 in juxtaposition to the bottom 118 of container 112 as shown in the various figures, particularly FIG. 3.

Figure 5:
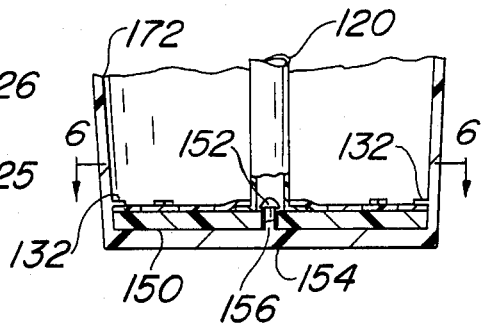
FIG. 5 is a broken away cross-sectional view illustrating an alternate embodiment of the present invention utilizing an alternate means for securing the base plate in juxtaposition to the bottom of the container.

Base plate 125, with expandable diaphragm 126 thereon, is held in juxtaposition to closed bottom 118 of container 116 by a securing means which may be in the form of a bead 127 through which base plate 125 is snapped. Securing means may be in the form of a retaining bead 127 which completely encircles the inside surface of sidewall 116. Alternatively, as shown in FIGS. 5 and 6, the securing means retaining the base plate in position may be in the form of a plurality of fingers or projections 132 formed around the inside surface of sidewall 116 near its lower end. The base plate 125 may also be formed of a special shape, such as the base plate having a relatively substantial thickness with the edges having a configuration, such as slants, with the inside of container 112 having a mating slanting surface 128. This provides the advantage of additional rigidity and support for the baseplate with respect to the inside of the container. However, this is a preferred embodiment which is not essential. An alternate embodiment is shown in FIG. 5 wherein the base plate 150 is of a thinner cross-section without special configuration on its edges.

FIG. 5 also discloses an alternate means for securing the base plate in juxtaposition to the bottom of the container, which may be utilized with or without projections 132 as previously discussed. As shown in FIG. 5, a snap type fastener in the form of arrowhead structure 152 is formed on the bottom 154 of container 172 which is adapted to mate with opening 156 in base plate 150. Arrowhead 152 may snappily engage alternate baseplate 150 by snapping through opening 156 formed in base plate 150. Preferably, such an arrowhead retaining structure would be centrally located to obviate any need for manual alignment and would project into the opening of tube 120. A ball or other shape snap, instead of an arrowhead, may serve equally well. Other means of securing the base plate to retain it in juxtaposition to the bottom of the container will be readily apparent to those skilled in the art.

Once the base plate is securly mounted in the bottom of the container with tube 120 attached to diaphragm 126, top 114 may be secured over opening 113. Preferably, top 114 may be threadably engaged to the upper end of sidewall 116 by mating threads 117 on sidewall 116 and threads 115 of top 114. Top 114 is provided with a sealing means 134 which may be comprised of a bellows 133, the sealing action of which may be enhanced by a sealing bead 123 on tube 120. The tube 120 is mounted through an opening in top 114 with sealing means 134 providing a seal between the outer surface of tube 120 and the opening through top 114. Sealing means 134 is of the type which allows movement of tube 120 in a direction toward or away from base plate 125 and/or 118 of container 112. In a preferred embodiment as shown in FIGS. 1 through 3, sealing means 134 may be comprised of a bellows type structure 133 constructed of a suitably thin flexible synthetic plastic material. The structure of top 114 and bellows 133 may be molded from a suitable flexible synthetic plastic material as a single unit, but other materials and methods of fabrication are understood to be within the bounds and spirit of the present invention.

Bead 123 on tube 120 provides the dual function of enhancing the seal between the bellows structure 133 and the outer surface of tube 120 and of enabling the spring action of the bellows 133 to provide an additional force in the direction of arrow 144 retaining tube 120 in the direction of arrow 144 thereby ensuring that tube 120 is maintained at its lower end in juxtaposition to base plate 125. This assists in maintaining diaphragm 126 in its unexpanded condition when a drinker is not applying a force to tube 120 in the direction of arrow 146.

The embodiment of the invention as illustrated in FIGS. 1 through 3 provides the important advantage of stackability of the container. It is noted that the drawings are not necessarily to scale and that a greater degree of increase of cross-sectional dimension for length of travel along the axis of frustro-conical container 112 may be desired to provide the maximum degree of stackability. In other words, containers 112 may be inserted one into another to decrease the amount of volume necessary in warehousing and shipping a specified number of containers from a manufacturer to a user, such as a movie theater operation, and decreases the amount of storage area necessary by the end user for storing the containers until the time that they are used. The embodiment of the present invention as shown in FIGS. 1 through 3, in addition to providing the significant advantage of stackability, provides an important advantage of increased economy in manufacture.

In accordance with the present invention, it is contemplated that the present invention may be utilized in various manners. One manner of usage is to provide the container of the present invention to the dispenser or user of the liquid in four components which may be readily assembled around the time of the filling of the container. The four components would be the container 112, the base plate 125 with expandable diaphragm 126 attached thereto, drinking tube 120 and top 114 or 160. The dispenser, such as an attendant at a snack counter in a movie theater, or an end user, such as a person about to take a drink onto a bus or boat, would insert the rim 121 of tube 120 into expandable diaphragm 126 as previously described with respect to FIG. 2. The base plate 125 with expandable diaphragm 126 and tube 120 attached thereto would be inserted into container 112 and secured to the bottom thereof by a suitable securing means such as retaining bead 127, projections 132, arrow head latch 152 or other suitable securing means. Once the container 112 is filled, top 114 would be inserted over tube 120 and secured to the top of container 112 by screwing top 114 thereto by means of threads or secured thereon by other suitable securing means.

All of the components of the drinking container may be manufactured by a suitable molding process such as blow molding or injection molding. However, diaphragm 126 may be comprised of rubber which may be adhesively bonded to base plate 125. However, preferably, diaphragm 126 may be molded from an elastic synthetic material and sonically welded around its periphery to base plate 125. Unitary molding of a complete unit of an expandable diaphragm on a base plate is possible with greater difficulty. Throughout, it is understood that reference to base plate 125 includes various other shapes of base plates, such as base plate 150 illustrated in FIG. 5. Furthermore, as discussed above, container 112 may be of other suitable cross-sectional shapes, such as hexagonal, octagonal or the like, and, in such instances, the base plate and expandable diaphragm would be of a mating configuration.

Container 112 may be molded from a synthetic plastic material in an inexpensive manner as is well known in the art. In a similar manner, top 114 with bellows structure 133 may be inexpensively molded as a unit. The lower end of bellows 133 would be molded to form a tight fit on tube 120 to provide a sealing function. Furthermore, it is recognized that any increased pressure in container 112, such as by squeezing the container, would further tighten the seal between bellows 133 and tube 120 by causing compression of the bellows structure 133 on the external surface of tube 120 at multiple points.

Rim 121 on the lower end of tube 120 may be of various suitable configurations sufficient to provide a means of attachment of the tube to the expandable diaphragm. Particularly, in a preferred embodiment, rim 121 may be an oval or tear dropped shape to enhance the ease of insertion of rim 121 into opening 130 of expandable diaphragm 126.

Figure 4:
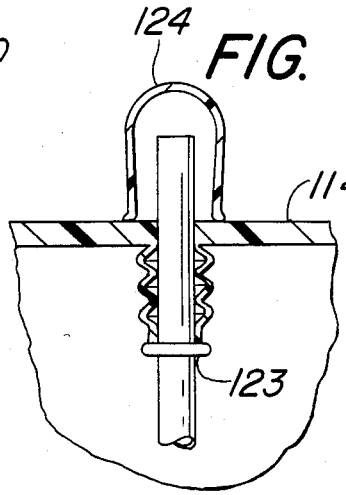
FIG. 4 is a broken away cross-sectional view illustrating an alternate embodiment which utilizes a sanitary cover over the drinking tube.

In addition to the use of the container in accordance with the present invention as aforesaid, wherein it would be assembled by the dispenser or end user, the container may be utilized for the prepackaged shipment of liquids. In such a case, means would be provided for sealing the upper end of tube 120 where it extends outside of container 112. One method of providing such a seal or sanitary cover is illustrated in FIG. 4. The portion of tube 120 extending out of tube 112 is provided with a removable cover 124 for sanitary purposes. Cover 124 may be readily removed, or it may be made of a sufficiently thin and tearable material to enable rapid removal by the tearing with ease of cover 124 thereby enabling drinking through tube 120 by a consumer. If desired, the container and its contents may be made sterile at the time of filling.

Another embodiment of the present invention is illustrated in FIG. 7 wherein a top 160 is illustrated. Top 160 is formed in the shape of a portion of a sphere, the surface of which is provided with an extremely slippery surface. The purpose of top 160 is to preclude the removal or at least the easy removal of the top under certan circumstances, such as by children in movie theaters wherein the top may be removed for various reasons with the resulting increased possibility of an undesired spill. Top 160 does not provide a good gripping surface for turning in view of its circumference being provided with an uncomfortable edge rather than a flattened gripping surface. The top 160 may be installed by dispenser, such as an attendant in a movie theater snack shop by utilizing a special high friction gripping cloth to initially install the cap after filling.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A non-spillable drinking container, comprising:

a container of linearly increasing cross-section provided with an open mouth at its larger end and a closed bottom at or near its smaller end;

a base plate with an expandable diaphragm mounted over substantially one surface of said base plate, said expandable diaphragm being provided with perforations therethrough which are normally closed in the unexpanded state of said expandable diaphragm and which are open when said expandable diaphragm is stretched by movement of a central portion of said diaphragm away from said one surface of said base plate;

a tube for drinking;

means for attaching said tube to said expandable diaphragm;

means for securing said base plate in juxtaposition to the bottom of said container; and a top for said container securably mountable over said open mouth of said container, said top including means for moveably mounting said tube through said top with means for forming a seal between said moveable tube and said top.

2. A non-spillable drinking container in accordance with claim 1 wherein said container is stackable with other like containers.

3. A non-spillable drinking container in accordance with claim 1 wherein said container of linearly increasing cross-section is a frustro-conical container.

4. A non-spillable drinking container in accordance with claim 1 wherein said open mouth of said container and said top for said container are provided with mating threads.

5. A non-spillable drinking container in accordance with claim 1 wherein said means for attachment of said expandable diaphragm to said tube is comprised of a rim at one end of said tube and a mating opening in said diaphragm.

6. A non-spillable drinking container in accordance with claim 1 wherein said means for securing said base plate in juxtaposition to the bottom of said container is comprised of a rim or bead around the inner surface of said container near said closed bottom with said base plate being selected to be of a size adapted to snap under said rim or bead and be retained thereby.

7. A non-spillable drinking container in accordance with claim 1 wherein said means for securing said base plate in juxtaposition to the bottom of said container is comprised of a plurality of projections mounted on the inside of said container near said closed bottom with said base plate being selected to be of a size adapted to snap under said projections and be retained thereby.

8. A non-spillable drinking container in accordance with claim 1 wherein said means for securing said base plate in juxtaposition to the bottom of said conical container is comprised of a latch means for fastening said closed bottom and said base plate together.

9. A non-spillable drinking container in accordance with claim 1 wherein said means for moveably mounting said tube through said top is comprised of a bellows structure.

10. A non-spillable drinking container in accordance with claim 1 wherein said means for forming a seal between said moveable tube and said top is comprised of a projection on said tube and a force fit opening through a bellows formed on said top.

* * * * *